US011098489B1

(12) United States Patent
Wheatley, III

(10) Patent No.: US 11,098,489 B1
(45) Date of Patent: Aug. 24, 2021

(54) DECK FLOORING BOARD CONNECTING BRACKET

(71) Applicant: Thomas F Wheatley, III, Sandy, UT (US)

(72) Inventor: Thomas F Wheatley, III, Sandy, UT (US)

( * ) Notice: Subject to any disclaimer, the term of this patent is extended or adjusted under 35 U.S.C. 154(b) by 0 days.

(21) Appl. No.: 17/015,522

(22) Filed: Sep. 9, 2020

(51) Int. Cl.
*E04F 15/02* (2006.01)
*E04B 1/00* (2006.01)

(52) U.S. Cl.
CPC ..... *E04F 15/02044* (2013.01); *E04B 1/003* (2013.01)

(58) Field of Classification Search
CPC ..... E04F 15/02044; E04F 2015/02094; E04B 1/003; E04B 2001/405
See application file for complete search history.

(56) References Cited

U.S. PATENT DOCUMENTS 4,925,141 A * 5/1990 Classen ..... E04B 1/2612 248/217.2
5,997,209 A * 12/1999 Sachs ..... E04F 15/04 403/388
D450,568 S * 11/2001 Sachs ..... D8/382
10,738,462 B2 8/2020 Bowker
10,895,080 B1 * 1/2021 MacKenzie ..... E04F 13/0835
2013/0025230 A1 * 1/2013 Turner ..... E04F 15/02183 52/586.1
2017/0051515 A1 * 2/2017 Aquilani ..... E04F 15/10
2017/0314278 A1 * 11/2017 Lee ..... E04G 23/0285
2017/0362815 A1 * 12/2017 Brigham ..... E04B 1/40
2021/0131121 A1 * 5/2021 MacKenzie ..... E04F 15/02183

FOREIGN PATENT DOCUMENTS

AT 506244 A2 * 7/2009 ..... E04F 15/04
DE 102014115257 A1 * 4/2016 ..... F16B 2/12

* cited by examiner

*Primary Examiner* — Theodore V Adamos
(74) *Attorney, Agent, or Firm* — Hanes & Bartels LLC

(57) ABSTRACT

A bracket for interconnecting the ends of deck flooring boards having a flat mounting plate for attachment to an underlying floor joist with a flat elliptically shaped blade attached perpendicularly along its center line to one end of the mounting plate and a flat shelf member attached to one side of the mounting plate mutually parallel with the blade and spaced therefrom a distance equal to one-half the thickness of the flooring boards to be interconnected.

4 Claims, 6 Drawing Sheets

DECK FLOORING BOARD CONNECTING BRACKET

The present invention relates to a hidden bracket for connecting the ends of deck flooring boards to an underlying floor joist without the use of nails or screws.

Traditionally, deck flooring boards are affixed to the underlying floor joists by the use of nails and screws. Such fasteners, when used on the ends of a flooring board tend to damage the end portion of the board. Additionally, these kinds of fasteners tend to work out over time creating uneven deck surfaces. The prior art has seen many efforts to utilize metal connectors of various designs and configurations to replace screws and nails in securing deck boards to the underlying support members. U.S. Pat. No. 10,738,462 for Deck Connector is an example of such prior art where the connector functions to secure both ends of adjoining deck boards to the floor joist however the connector is complex in its configuration and the ends of the adjoining deck boards are spaced apart. Other prior art devices suffer from some of the same problems.

Accordingly, it is the object of the present invention to provide a deck board connector that is simple in its construction and is configured to connect the ends of deck boards to the underlying floor joist and, at the same time, bring the ends of the deck boards into abutting relation to provide a smooth and continuance appearance to the finished deck.

SUMMARY OF THE INVENTION

The bracket of the present invention is configured to interconnect the ends of longitudinally adjoining deck flooring boards and to anchor those ends to the underlying floor joist and comprises a flat mounting plate having a flat elliptically shaped blade attached perpendicularly to one end of the mounting plate and a flat shelf member attached to the side of the mounting plate mutually parallel with the blade and spaced therefrom a distance equal to one-half the thickness of the flooring boards to be interconnected.

DETAILED DESCRIPTION OF A PREFERRED FORM OF THE INVENTION

Figure 1B:
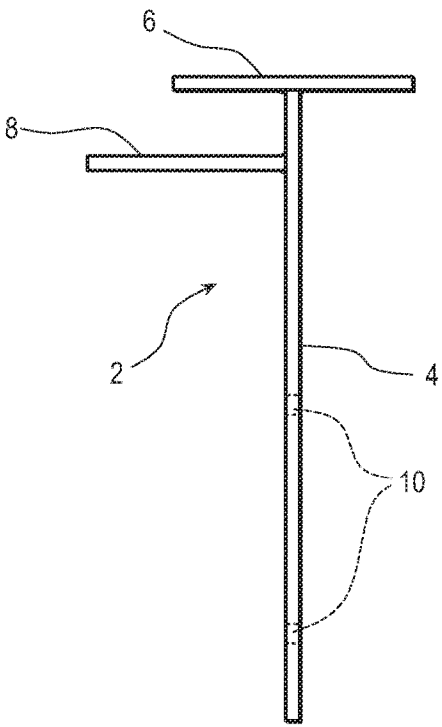
FIG. 1B is an end view of the bracket.
Figure 1C:
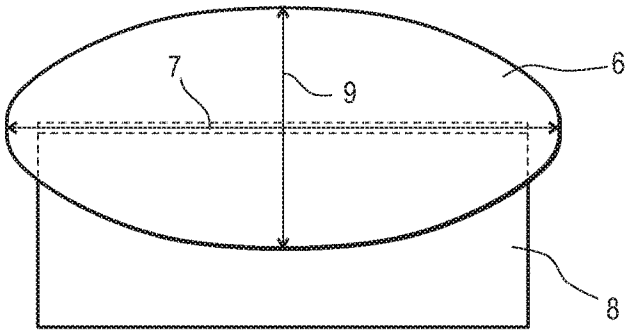
FIG. 1C is a top view of the bracket.
Figure 1A:
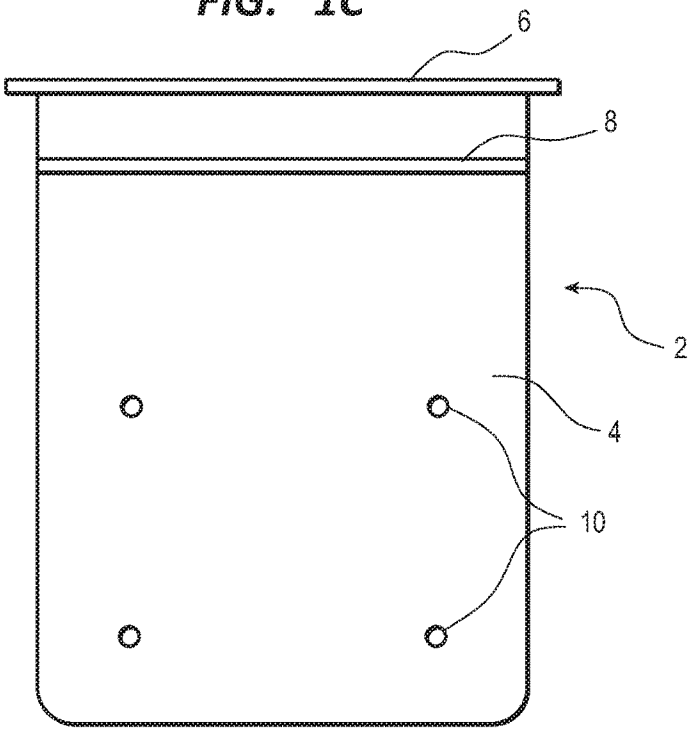
FIG. 1A is a side view of the bracket of the present invention.
Figure 2:
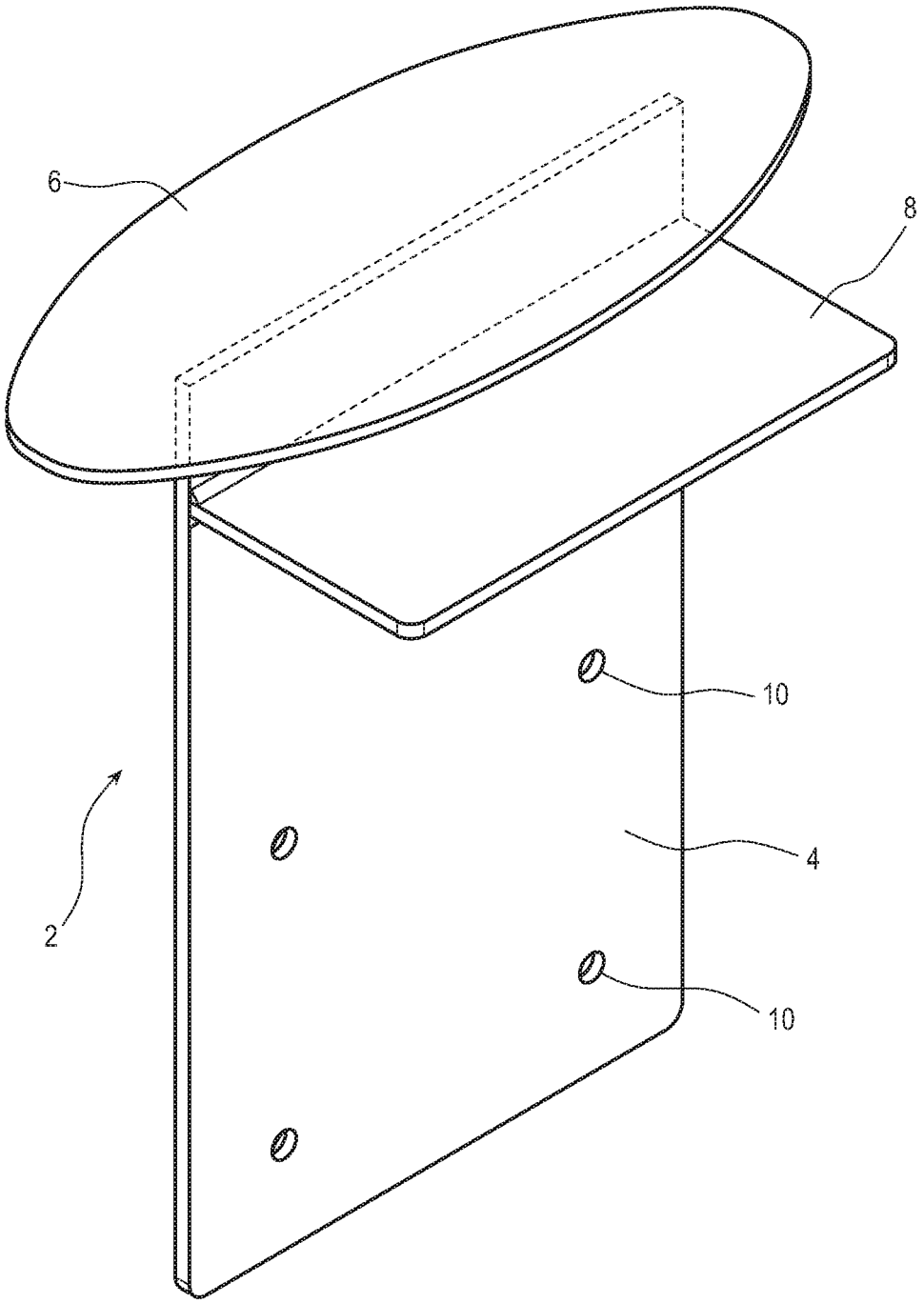
FIG. 2 is a top perspective view of the bracket.

As seen in FIGS. 1A, 1B and 1C, the bracket 2 of the present invention comprises three rigid, preferably metal, interconnected components. The top end of a flat rectangular mounting plate 4 is connected perpendicularly to a flat elliptically shaped blade 6 along the blade's major axis 7. A flat rectangular shelf member 8 is attached perpendicularly along its long edge to the side of the mounting plate 4, mutually parallel with the blade 6 and spaced therefrom a distance equal to one-half the thickness of the flooring boards to be interconnected. The width of the shelf member exceeds the dimension of one-half the length of the minor axis 9 of the blade.

Figure 3:
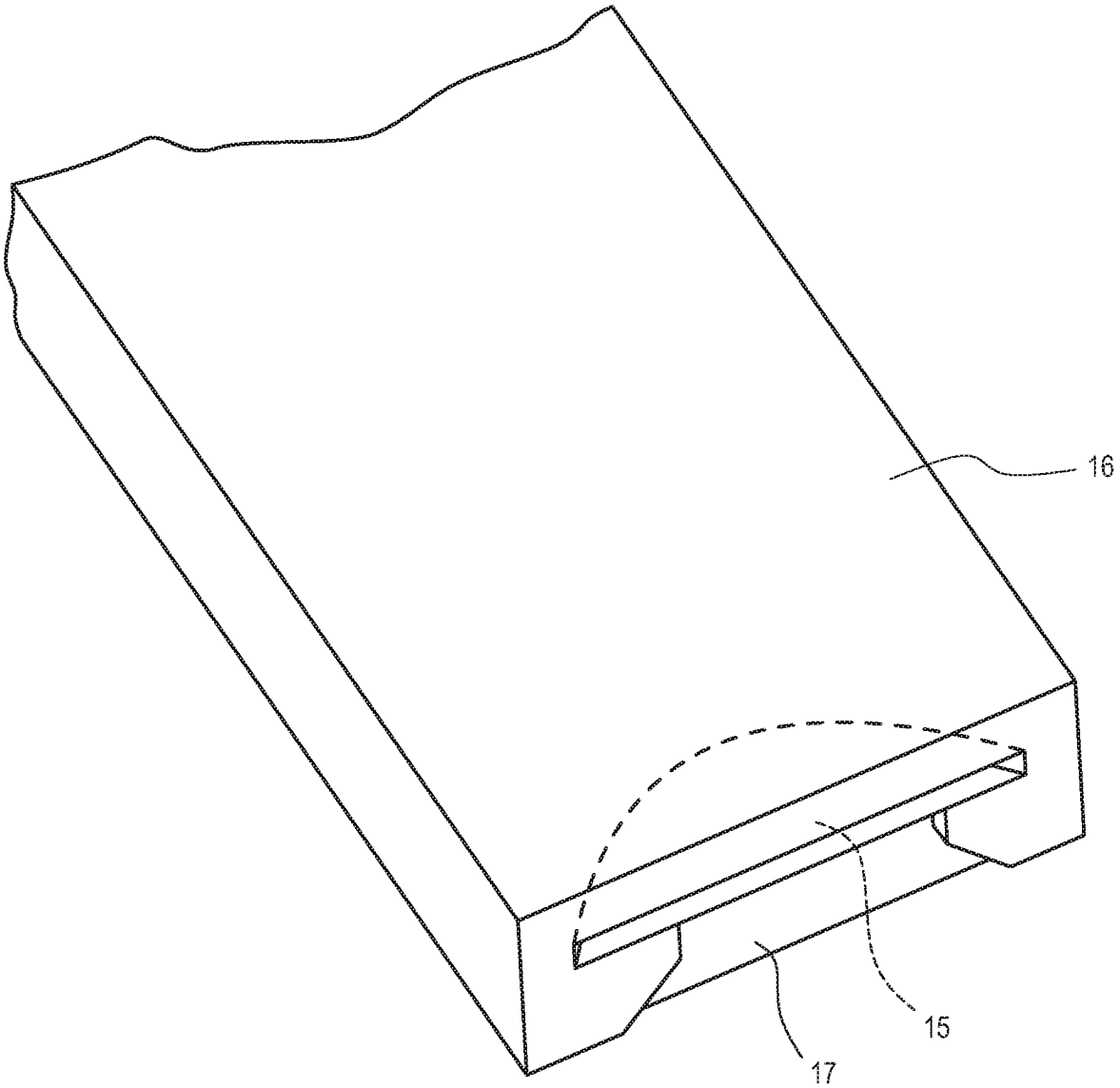
FIG. 3 is a fragmentary perspective view of the prepared end of a flooring board.

Referring to FIG. 3, a fragmentary deck board 16 is shown with a slot 15 and an indentation 17 in the end of the board. The slot and indentation are created by a tool such as a biscuit jointer. The slot and indent are made in the end of both deck boards whose ends are to be abutted. The slot 15 is created to receive the one-half of the elliptically shaped blade 6 that is on one side of the blade's major axis 7. The indent 17 is created to receive one half of the thickness of the mounting plate 4 in order that when the ends of the deck boards 16 and 18 are abutted they will be flush with one another.

Figure 4:
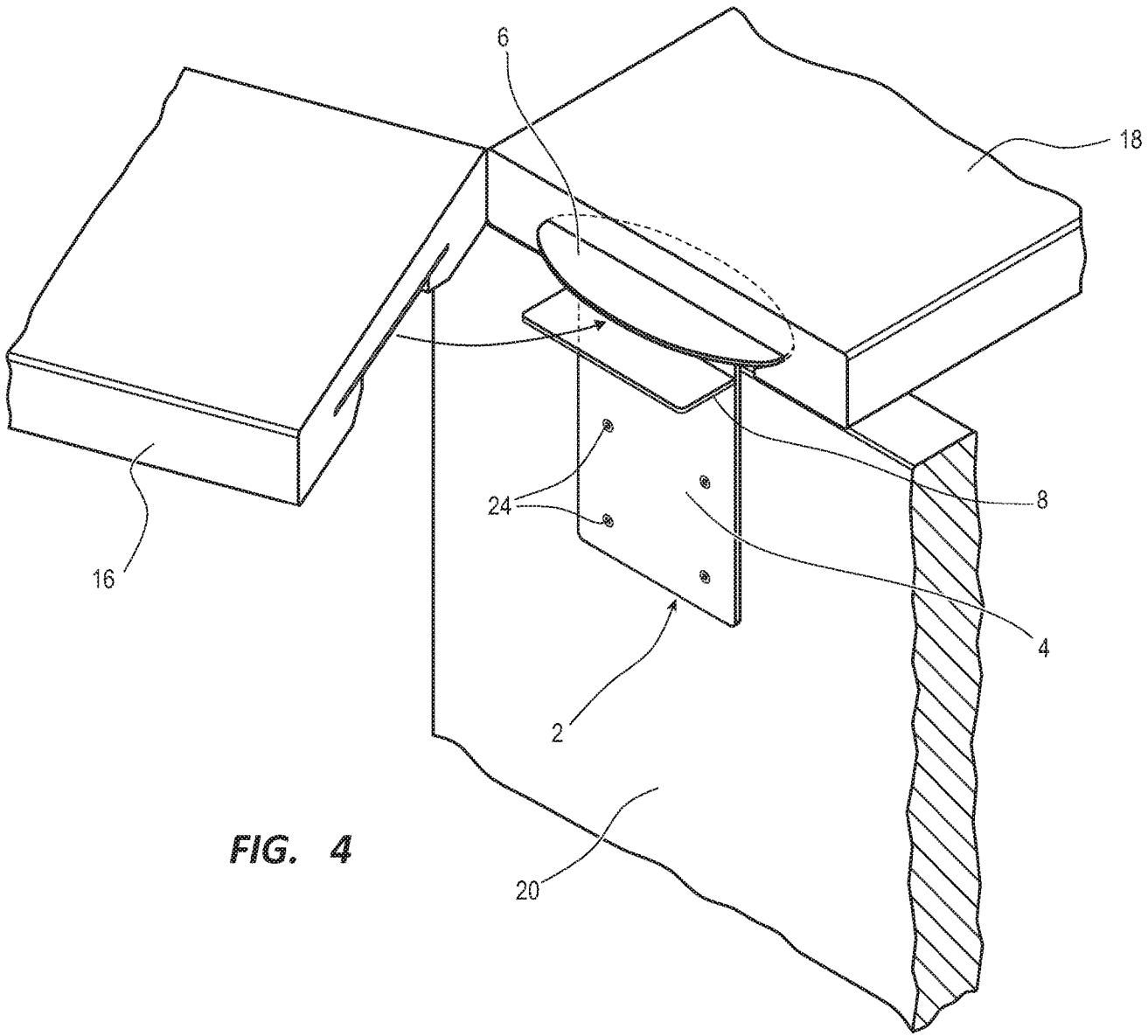
FIG. 4 is a perspective view of the bracket inserted into the end of a first deck board and attached to an underlying floor joist with a second deck board in position to be abutted to the first deck board.

FIG. 4 illustrates the end of a first deck board 18 disposed on the top edge of a floor joist 20. The mounting plate 4 of the bracket 2 is attached by screws 24 to the side of the floor joist while one-half of the blade 6 of the bracket is inserted into the slot 15 in the end of the deck board 18. The second deck board 16 that is to be abutted to the first deck board 18 is shown in position to accept the other one-half of the blade 6 into the slot 15 of the second deck board 16.

Figure 5:
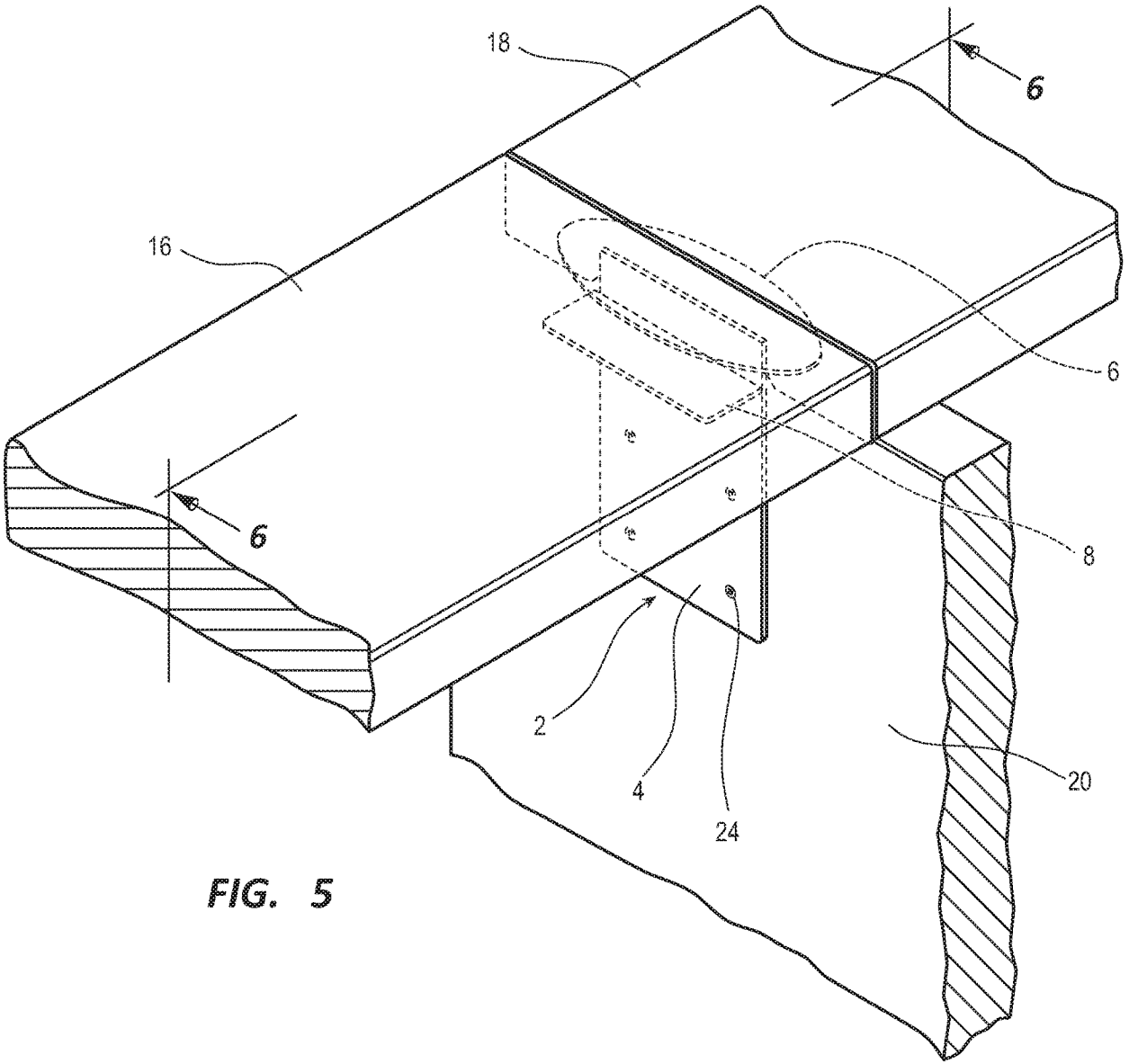
FIG. 5 is a perspective view of abutted deck boards with the hidden bracket shown in dotted lines.
Figure 6:
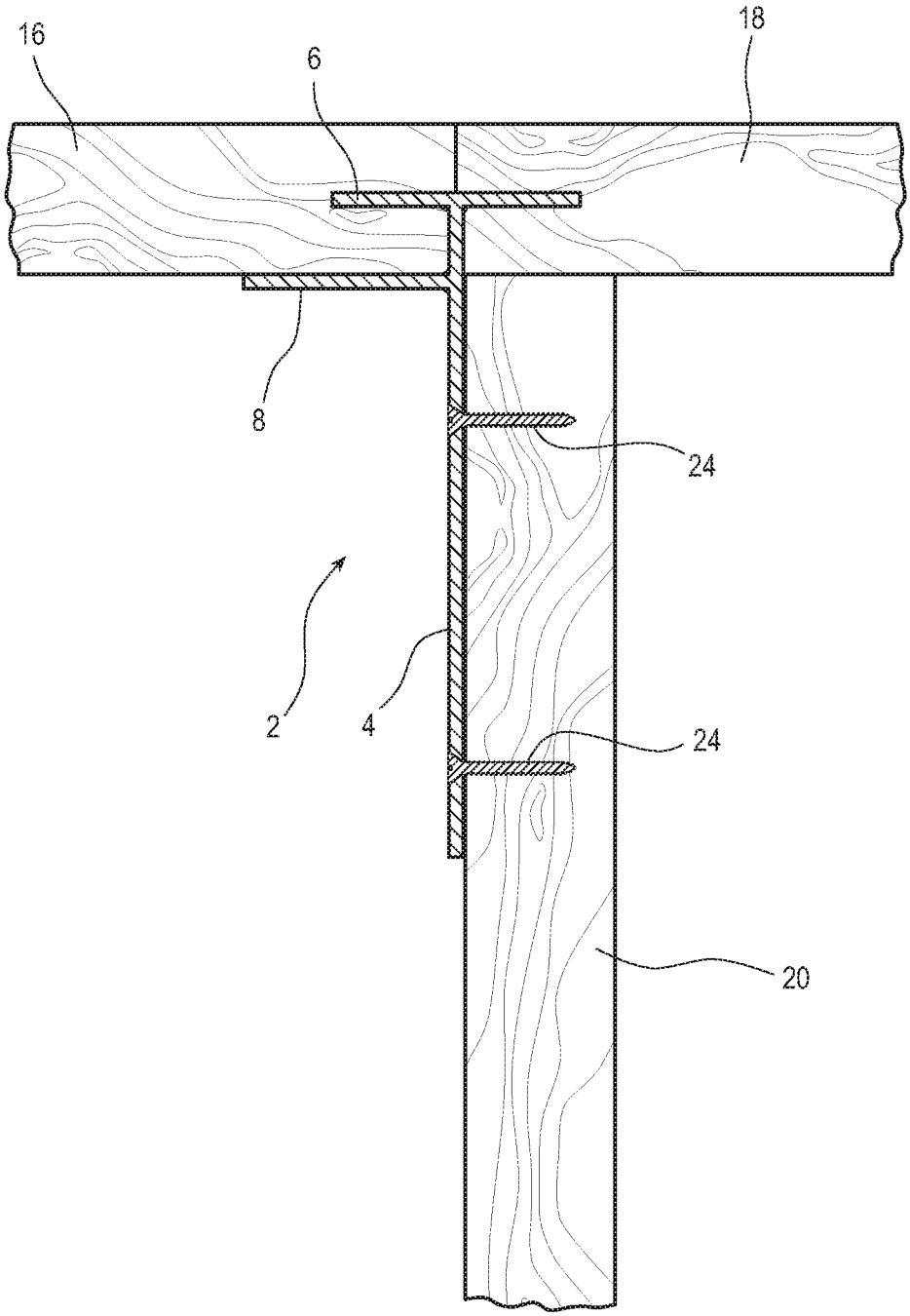
FIG. 6 is a cross sectional view taken along lines 6-6 of FIG. 5.

The completed abutment of the deck boards 16 and 18 is shown in FIGS. 5 and 6 where the portion of the second deck board 16 that is below the slot 15 is disposed in the space between the blade 6 and the shelf member 8 of the bracket 2. The shelf member 8, together with the one-half of the blade 6 provides support for the end of the second deck board 16. The floor joist 20 provides a load bearing platform for the end of the second deck board 18. The tight fit of the blade 6 into the respective slots 15 in the abutting deck boards 16 and 18 maintains the deck boards in abutting relation.

Thus, it is seen that use of the bracket 2 achieves the objectives of the invention in affixing abutting ends of deck boards to a floor joist without the use of nails or screws.

I claim:

1. A bracket for interconnecting the terminal ends of flooring boards having a thickness comprising, a flat mounting plate having a width, first and second sides, a first end equal in length to the width of the plate, and an opposite second end;

a flat elliptically shaped blade having major and minor axes, where the blade is attached, along the major axis, perpendicularly to the first end of the mounting plate; and a flat shelf member coincident in width with the mounting plate and attached to the first side of the mounting plate over the full width of the mounting plate and between the first and second ends of the mounting plate, where the shelf member is disposed mutually parallel with the blade and spaced therefrom a distance equal to one-half the thickness of the flooring boards to be interconnected.

2. The bracket of claim 1 where the shelf member is rectangular and includes a short side and a long side where the length of the long side is equal to the width of the mounting plate.

3. The bracket of claim 2 where the length of the short side exceeds the dimension of one-half the length of the minor axis of the blade.

4. The bracket of claim 3 and further including, a plurality of apertures in the mounting plate.

* * * * *